United States Patent [19]

Gerlach et al.

[11] Patent Number: 4,571,525

[45] Date of Patent: Feb. 18, 1986

[54] RESONANT COAXIAL CAVITIES FOR A GRID VACUUM TUBE

[75] Inventors: Pierre Gerlach; Claude Grolleau, both of Thonon les Bains, France

[73] Assignee: Thomson-CSF, Paris, France

[21] Appl. No.: 562,444

[22] Filed: Dec. 16, 1983

[30] Foreign Application Priority Data

Dec. 23, 1982 [FR] France ..... 82 21621

[51] Int. Cl.[4] ..... H01J 7/46; H01J 19/80

[52] U.S. Cl. ..... 315/39; 331/101; 330/45

[58] Field of Search ..... 315/39; 331/101, 102; 330/45

[56] References Cited

U.S. PATENT DOCUMENTS

| | | | |
|---|---|---|---|
| 2,434,115 | 1/1948 | McArthur | 315/39 |
| 2,642,533 | 6/1953 | Preist | 315/39 X |
| 2,681,997 | 6/1954 | Haeff et al. | 315/39 X |
| 2,828,438 | 3/1958 | McArthur | 315/39 |
| 2,948,858 | 8/1960 | Stameson | 315/39 X |
| 4,119,921 | 10/1978 | Warringa et al. | 315/39 |

OTHER PUBLICATIONS

The Radio and Electronic Engineer, vol. 45, No. 6, Jun. 1975, C. A. Jeness: "A 150-MHz Coaxial Line Radar Transmitter for the Study of Radar Aurora", pp. 311-319* pp. 312-314, paragraph 3.1.2; pp. 318-319; paragraph 7*.

*Primary Examiner*—Saxfield Chatmon

*Attorney, Agent, or Firm*—Roland Plottel

[57] ABSTRACT

The means providing capacitive decoupling between the inside cylinder and a grid electrode are disposed at about one fourth of the wavelength of the highest operating frequency from the tube end of the inside cylinder. This is a current node, and dielectric losses at the highest frequency are thus greatly reduced. The match is less good at lower frequencies, but the corresponding dielectric losses are much less at lower frequencies. The first piston provides capacitive coupling between the first and second cavities whereby the entire outside cylinder may be maintained at ground potential.

8 Claims, 2 Drawing Figures

RESONANT COAXIAL CAVITIES FOR A GRID VACUUM TUBE

FIELD OF THE INVENTION

The present invention relates to resonant coaxial cavities for a grid vacuum tube, ie. a tube such as a triode or tetrode, etc. which includes at least one grid electrode.

BACKGROUND OF THE INVENTION

Description of the Prior Art

French patent application number 78.36248 filed Dec. 22nd, 1978 in the name of Thomson-CSF describes coaxial resonant cavities for grid vacuum tubes, in which the cavities are constituted by a coaxial line separated into a plurality of elementary resonators by pistons. The cavity-separating pistons may also provide coupling for the cavities. This coupling may be capacitive (see FIG. 2 of the above-mentioned patent application), or it may be inductive (see FIG. 4 thereof). The coupling may be adjustable; for example FIG. 3 of the above-mentioned patent application shows how an adjustable capacitive coupling may be obtained by using a piston having two parts A and B which are nested one in the other. Further, by changing the position of the pistons along the line by means of a system of slots and lugs, or by means of rods, the cavities can be frequency tuned.

These coaxial cavities are coupled to the input circuit or to the output circuit of the grid vacuum tube, eg. in tubes which are used in power amplifiers for TV transmitters which are required to meet precise passband specifications.

For safety reasons, it is general practice to ground both of the cylinders which constitute the coaxial line.

The cylinders are then capacitively decoupled from two electrodes of the tube in order to DC isolate the cylinders from the electrodes. Such capacitive decoupling is generally performed by means of an insulating sheet which is clamped between two cylindrical members.

In the prior art, capacitive decoupling between the cylinders and the electrodes is provided at the tube ends of the cylinders, thus grounding the cylinders over their entire length.

A problem arises at the highest frequencies at which the cavities operate, in which the piston of the first cavity starting from the tube end is situated close to the tube ends of the cylinders. The pistons are located at voltage nodes in the system of standing waves which is established in the line, and hence at current antinodes.

The insulating sheet which provides capacitive decoupling between the inside cylinder and one of the tube electrodes is thus situated in a high current zone. Losses in the dielectric are high. Such losses, in addition to constituting a drawback in their own right, additionally give rise to increased temperatures in a location which is very difficult to cool.

Preferred embodiments of the present invention solve this problem.

SUMMARY OF THE INVENTION

According to claim 1, the present invention provides resonant cavities for a grid vacuum tube, the cavities being constituted by a coaxial line which is divided into a plurality of resonant cavities by at least two pistons adjustable in position along the coaxial line. Said line is constituted by an inside cylinder placed coaxially inside an outside cylinder, said both cylinders being grounded and comprising means including capacitive decoupling between the cylinders and two respective associated electrodes of the vacuum tube. The improvement wherein said means providing capacitive decoupling between the inside cylinder and the associated one of the electrodes of the vacuum tube are disposed along said cylinder at a distance D from said tube, said distance D lying between the positions occupied by the first and second pistons from the tube end at the highest operating frequency of the cavities. Further, said first piston provides capacitive coupling between the first and the second cavities from the tube end.

In a preferred embodiment of the invention, said means providing capacitive decoupling between the inside cylinder and the associated electrode of the vacuum tube are disposed at a distance from the tube end of the inside cylinder substantially equal to one fourth of the wavelength ($\lambda_M/4$) of the highest operating frequency of the cavities.

Thus, according to the invention, the means which provide capacitive decoupling between the inside cylinder and an associated one of the electrodes of the vacuum tube are located at a position (preferably the $\lambda_M/4$ position) in which currents are low at the highest operating frequency.

At lower frequencies, the decoupling is not at the optimum position, but since current drops off steeply with decreasing frequency, losses remain small.

Said capacitive decouping means cannot be displaced unless the nearest piston to the tube end provides capacitive coupling between the first and second cavities. This ensures that the outside cylinder is kept grounded in spite of said means being displaced.

The invention can be used to obtain the following advantages, inter alia:

a reduction of losses in the dielectric in contact with the inside cylinder;

improving the efficiency of the cavity; and reducing the temperature of the dielectric.

BRIEF DESCRIPTION OF THE DRAWINGS

An embodiment of the invention is described by way of example with reference to the accompanying drawing, in which.

Where the same item occurs in both figures, it is given the same reference numeral, and for reasons of clarity neither of the figures is drawn to scale.

DESCRIPTION OF THE PREFERRED EMBODIMENTS

Figure 1:
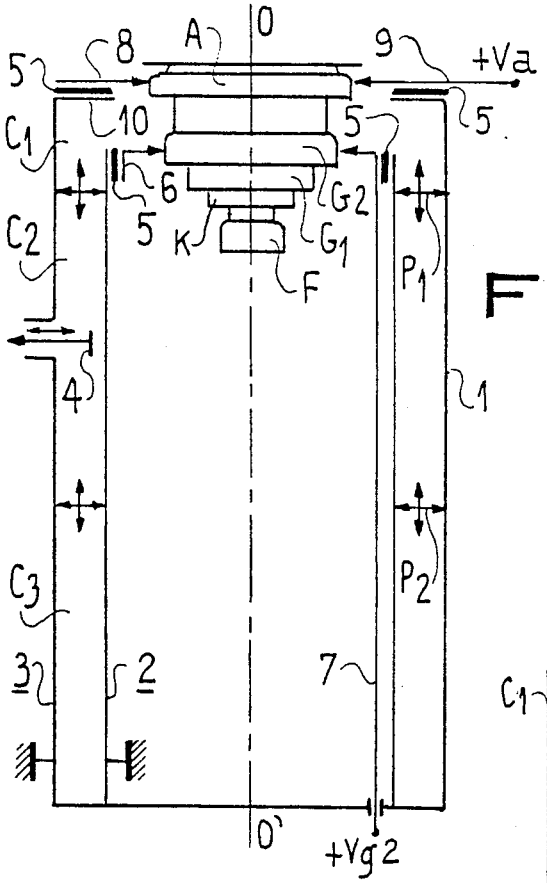
PRIOR ART FIG 1
FIG. 1 is a longitudinal section through a tetrode including prior art coaxial cavities.

FIG. 1 is a longitudinal section through a tetrode including prior art coaxial cavities.

The tetrode is shown in highly diagrammatic form in the figure. Its filament is designated F, its cathode K, its control grid $G_1$, its screen grid $G_2$, and its anode A. The assembly is naturally circularly symmetrical about an axis O-O'.

The coaxial cavities shown in FIG. 1 are coupled by way of example to the output circuit of the tetrode.

The cavities are constituted by a coaxial line 1 comprising an inside cylinder 2 and an outside cylinder 3, which cylinders are coaxial. The coaxial line 1 is divided into a plurality of elementary resonant cavities $C_1$, $C_2$, $C_3$, by pistons $P_1$, $P_2$, whose positions along the line can be adjusted. The pistons are symbolically represented on the figure by respective pairs of horizontal arrows. Their optional displacement is represented by respective pairs of vertical arrows. A plane capacitor 4 serves to extract energy from the second cavity in the figure. Coupling means between successive adjacent cavities are not shown in FIG. 1. They may be constituted by plane capacitors, or, for example, by the pistons themselves providing capacitive or inductive coupling as described in the above-mentioned patent application.

The first cavity $C_1$ is coupled to the tube, and the last cavity $C_3$ is terminated by a short circuit.

Both cylinders 2 and 3 are grounded. An insulating sheet 5 DC insulates the inside cylinder 2 from the grid $G_2$. The sheet 5 is clamped between the inside cylinder 2 and another cylinder 6 which is short and of small diameter and which is connected to the grid $G_2$. Said cylinder 6 is also connected via a connection 7 to recieve the bias voltage $V_{G2}$ for the grid $G_2$, which may be about 1 KV, for example. As has already been explained, it is common practice for the insulating sheet 5 to be placed at the end of the cylinder 2 which is adjacent to the tube. The entire length of the inside cylinder 2 is thus grounded. Further, if the first piston $P_1$ provides a DC electrical connection between both cylinders 2 and 3, it may be displaced along the entire length of the inside cylinder 2 without running the risk of connecting the outside cylinder 3 at any point to the DC voltage of the grid $G_2$. An insulating sheet 5 is also clamped between the outside cylinder 3 and a washer 8 which is connected to the anode A. Said washer 8 is also connected to receive the anode bias voltage $V_A$ via a connection 9.

In FIG. 1, it can be seen that the upper insulating sheet is clamped between an inwardly directed flange constituting the washer 8 which is connected to the anode A and to the connection 9 and an inwardly directed flange which terminates the outside cylinder 3.

If the outside cylinder 3 is not fitted with such a flange 10*a*, then the insulating sheet is clamped vertically at the end of the outside cylinder 3, beyond the cavity $C_1$.

As explained above, a problem arises as frequency increases, which requires the pistons to be moved towards the top of FIG. 1 to maintain tuning. At the highest frequencies of the circuit, the piston $P_1$ is level with the insulating sheet 5 of the inside cylinder 2. This gives rise to large dielectric losses in the insulating sheet.

Figure 2:
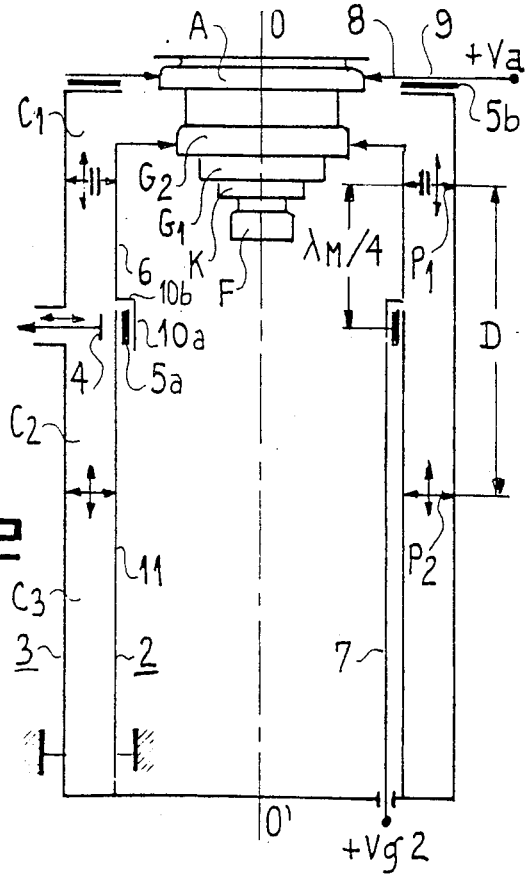
FIG. 2 is a longitudinal section through a tetrode including coaxial cavities in accordance with the invention.

FIG. 2 is a longitudinal section through a tetrode associated with coaxial cavities in accordance with the invtention. The main difference between FIGS. 1 and 2 lies in the location of the means providing capacitive decoupling between the inside cylinder 2 and the grid $G_2$.

In FIG. 2, these decoupling means are located at a distance from the tube end substantially equal to one fourth of the wavelength of higest frequency at which the cavities operate, ie. at $\lambda_M/4$ from the end. Thus, at the highest frequency, current is substantially zero in the dielectric 5 used for coupling the inside cylinder. At lower frequencies, the coupling is no longer at an optimal position, but since current falls off rapidly with a drop in frequency, losses are still greatly reduced.

In a more general manner, in order to minimise losses in the dielectric which is used for coupling the inside cylinder, the coupling is located at a distance marked $\lambda/4$ in FIG. 2 from the tube end, where $\lambda/4$ lies between the positions occupied by the first and second pistons $P_1$ and $P_2$ at the highest operating frequency of the cavities.

The inside cylinder 2 thus comprises two portions:

a first portion 9 which is connected to the grid $G_2$ and which includes a joggle 10*b* leading to a rim 10*a* of smaller diameter for receiving the dielectric 5*a* or for containing an air gap as the dielectric for a capacitive coupling; and a second portion 11 of constant diameter.

As can be seen in FIG. 2, the first piston $P_1$ must establish capacitive coupling between the first and second cavities. Thus, although the first portion 6 of the inside cylinder 2 is not grounded, the entire outside cylinder 3 remains grounded, which is important for saftey reasons.

The other piston $P_2$ in the coaxial line may provide capacitive coupling, or inductive coupling, or it may provide a DC connection between the inside and outside cylinders if the coupling is provided by a plane capacitor, for example.

The insulating material which is used to provide capacitive decoupling between the outside and inside cylinders and two electrodes of the tube may be polytetrafluoroethylene, polyimide, or mica, for example.

Capacitive decoupling may also be provided by an air gap between the cylinders and the electrodes.

Cavities in accordance with the invention may be used on the input circuits or on the output circuits of a grid vacuum tube such as a triode, or a tetrode, etc . . . . They are particularly utilised with high power tubes, eg. operating at two kilowatts or more. They may be used, for example, on tubes operating in the UHF band between 470 MHz and 850 MHz.

When used on a triode output circuit, the coaxial line is decoupled from the anode and from the control grid.

Since the outside cylinder is longer than the inside cylinder, the dielectric used for decoupling 5*b* the outside cylinder from the associated electrode 9 of the tube can be placed at a location where current is low at the highest operating frequency of the cavities, eg. at the end of the outside cylinder as shown in FIGS. 1 and 2.

We claim:

1. Resonant cavities for a grid vacuum tube, comprising a coaxial line divided into a plurality of resonant cavities (C1, C2, C3) by at least two pistons ($P_1$, $P_2$) adjustable in position along the coaxial line, said line having an inside cylinder (2) placed coaxially inside an outside cylinder (3), both cylinders being grounded; capacitive decoupling (5*a*, 5*b*) between the cylinders (2, 3) and two respectively associated electrodes ($G_2$, A) of the vacuum tube; the decoupling (5*a*) between the inside cylinder (2) and said associated electrode (G2) being positioned at a distance from said associate electrode ($G_2$) approximately equal to $\frac{1}{4}$ wave length of the highest operating frequency of the cavities; and said decoupling (5*a*) dividing said inside cylinder (2) into two parts (6 and 11) one (6) connected to said associated electrode ($G_2$), and the other (11) connected to the ground, said decoupling (5*a*) insulating said one part (6) from the other (11).

2. Cavities according to claim 1 wherein said capacitive decoupling comprises air gap.

3. Cavities according to claim 1, wherein said capacitive decoupling between said cylinders and said electrodes are constituted by respective sheets of insulating material.

4. Cavities according to claim 1, wherein the pistons provide coupling between successive pairs of resonant cavities.

5. Cavities according to claim 2, wherein the pistons provide coupling between successive pairs of resonant cavities.

6. Cavities according to claim 3, wherein the pistons provide coupling between successive pairs of resonant cavities.

7. Cavities according to claim 1, wherein the inside cylinder comprises two portions:

a first portion (6) which is connected to an associated electrode (G2) of the tube and which includes a joggle (10*b*) leading to a rim (10*a*) of smaller diameter in which insulating material or air is lodged; and a second portion (11) of constant diameter.

8. Cavities according to claim 1, wherein the outside cylinder is longer than the inside cylinder and wherein the means providing capacitive decoupling between the outside cylinder and an associated one of the electrodes of the vacuum tube are disposed at the tube end of the outside cylinder.

* * * * *